US007459259B2

(12) United States Patent
Engel et al.

(10) Patent No.: US 7,459,259 B2
(45) Date of Patent: Dec. 2, 2008

(54) MARKED ARTICLE AND METHOD OF MAKING THE SAME

(75) Inventors: David B. Engel, Clifton Park, NY (US); David G. Gascoyne, Scehectady, NY (US); Vandita Pai-Paranjape, Evansville, IN (US); Radislav A. Potyrailo, Nishayuna, NY (US); Philippe Schottland, Evansville, IN (US); Micah Sakiestewa Sze, Albany, NY (US); Marc B. Wisnudel, Clifton Park, NY (US)

(73) Assignee: SABIC Innovative Plastics IP B.V., Bergen op Zoom (NL)

( * ) Notice: Subject to any disclaimer, the term of this patent is extended or adjusted under 35 U.S.C. 154(b) by 16 days.

(21) Appl. No.: 10/953,680

(22) Filed: Sep. 29, 2004

(65) Prior Publication Data

US 2006/0068316 A1 Mar. 30, 2006

(51) Int. Cl.
*G03C 1/00* (2006.01)
*G03C 7/00* (2006.01)

(52) U.S. Cl. ..... 430/270.1; 430/363; 430/945

(58) Field of Classification Search ..... 430/270.1, 430/363, 945; 204/157.61; 219/121.61; 252/625, 646, 647; 264/1.1, 1.36, 1.37, 409, 264/482; 427/508, 596
See application file for complete search history.

(56) References Cited

U.S. PATENT DOCUMENTS

| | | | | |
|---|---|---|---|---|
| 3,740,761 | A * | 6/1973 | Fechter | 346/135.1 |
| 4,809,022 | A | 2/1989 | Wilkinson et al. | 346/135.1 |
| 4,816,374 | A | 3/1989 | Lecomte | 430/270 |
| 4,961,077 | A | 10/1990 | Wilson et al. | 346/1.1 |
| 5,786,132 | A | 7/1998 | Nohr et al. | 430/343 |
| 5,844,593 | A | 12/1998 | Proffitt et al. | 347/262 |
| 6,214,917 | B1 * | 4/2001 | Linzmeier et al. | 524/430 |
| 6,380,547 | B1 | 4/2002 | Gonzalez et al. | 250/458.1 |
| 6,423,478 | B1 | 7/2002 | Ha | 430/321 |
| 6,545,065 | B2 | 4/2003 | Solms et al. | 523/171 |

(Continued)

FOREIGN PATENT DOCUMENTS

EP 0190997 A2 8/1986

(Continued)

OTHER PUBLICATIONS

McKee, Terry. "Laser Marking of Polyethylene and other Polyolefins with Additives." Nov./Dec. 1995. Plastics Formulating & Compounding, pp. 27-32.*

(Continued)

*Primary Examiner*—Cynthia H Kelly
*Assistant Examiner*—Connie P Johnson

(57) ABSTRACT

A method of marking a thermoplastic article can comprise: combining a thermoplastic with a light-marking additive to form a composition, forming the composition into an article having a maximum optical absorption wavelength; and illuminating, at a marking wavelength, at least a portion of the article with a device having a power of less than or equal to about 200 mW, to form a light-mark. The light-mark can have a size, as measured along a major axis, of greater than or equal to about 10 micrometers. The light-mark can also have a mark absorption wavelength that is greater than or equal to about ±100 nm of the maximum optical absorption wavelength, and can have a spectral absorption curve.

40 Claims, 2 Drawing Sheets

U.S. PATENT DOCUMENTS

| | | | | |
|---|---|---|---|---|
| 6,589,626 | B2 | 7/2003 | Selinfreund et al. | 428/64.1 |
| 6,600,706 | B1 | 7/2003 | Gotoh et al. | 369/47.15 |
| 6,627,299 | B1 * | 9/2003 | Feng et al. | 428/207 |
| 6,638,593 | B2 | 10/2003 | Selinfreund et al. | 428/64.1 |
| 7,217,745 | B2 * | 5/2007 | Edler | 523/171 |
| 2002/0048225 | A1 | 4/2002 | Shinoda | |
| 2002/0107305 | A1 | 8/2002 | Edier | 523/171 |
| 2002/0155381 | A1 | 10/2002 | Berneth et al. | 430/270.15 |
| 2003/0008234 | A1 | 1/2003 | Berneth et al. | 430/270.2 |
| 2003/0013041 | A1 | 1/2003 | Berneth et al. | 430/270.18 |
| 2003/0096192 | A1 | 5/2003 | Berneth et al. | 430/270.15 |
| 2003/0141491 | A1 | 7/2003 | Sato et al. | 252/588 |
| 2004/0004922 | A1 | 1/2004 | Selinfreund et al. | 369/53.21 |
| 2004/0110088 | A1 | 6/2004 | Vig et al. | 430/270.15 |
| 2004/0121262 | A1 | 6/2004 | Selinfreund et al. | 430/270.15 |
| 2004/0121268 | A1 | 6/2004 | Conroy et al. | 430/321 |
| 2004/0152008 | A1 | 8/2004 | Heneghan et al. | 430/270.1 |

FOREIGN PATENT DOCUMENTS

| | | | |
|---|---|---|---|
| EP | 0 438 225 | A1 | 1/1991 |
| EP | 0697433 | A1 | 2/1996 |
| EP | 0993964 | A2 | 4/2000 |
| WO | 94/12352 | A1 | 6/1994 |
| WO | WO 94/12352 | A1 | 6/1994 |
| WO | WO9412352 | * | 6/1994 |
| WO | WO 98/31011 | A2 | 7/1998 |
| WO | 01/38103 | A1 | 5/2001 |
| WO | WO 02/053553 | A1 | 7/2002 |
| WO | WO 03/087888 | A2 | 10/2003 |
| WO | WO 03/107331 | A1 | 12/2003 |
| WO | WO 2004/052654 | A1 | 6/2004 |
| WO | WO 2004052654 | A1 * | 6/2004 |

OTHER PUBLICATIONS

"Laser Marking of Polyethylene and other Polyolefins with Additives", Terry McKee, Plastics Formulating and Compounding, Nov./Dec. 1995, pp. 27.*

Yves Geerts et al., "Quaterrylenebis(dicarboximide)s: near infrared absorbing and emitting dyes", J. Mater. Chem., 1998, 8(11), 2357-2369.

William B. Tuemmler et al., "Polymethine Dyes. I. A Comparison of Several Vinylogous Series in which the Polymethine Chains are Terminated by Aryl Groups", Journal of the American Chemical Society (1958), vol. 80, pp. 3772-3777.

International Search Report, International Application No. PCT/US2005/034452; International Filing Date: Sep. 23, 2005; 6 pages.

International Search Report, International Application No. PCT/US2005/034490; International Search Report Mailing Date: Feb. 15, 2006; 3 pages.

English Abstract for EP0190997.

* cited by examiner

MARKED ARTICLE AND METHOD OF MAKING THE SAME

BACKGROUND

A major problem confronting companies, governments, agencies, and the like, is the production of false identification (e.g., passports, social security cards, security cards, driver's license, and so forth). For example, passports are employed to control the movement of individuals across a country border. With respect to companies, government laboratories, and the like, security cards are often provided to employees to enable access to the company, to high security areas, to sensitive data, and so forth. False security cards can enable un-authorized individuals access to confidential information, trade-secrets, national security information, and the like. Counterfeiting is also becoming increasingly common with payment cards such as debit and credit cards, store purchase cards, phone cards, and the like. These cards are also becoming increasingly complex and carry graphics or codes that can be used to provide more protection against piracy (e.g., credit card carrying the picture of the cardholder).

Although security is attempted by rigorous background checks and the like prior to issuance of the identification documents (e.g., passport, security card, . . . ), this process does not solve the problem of counterfeit documents. There remains a need, therefore, for counterfeit resistant, objectively authenticatable identification documents, and the like.

SUMMARY

Disclosed herein are light-markable articles, light-marked articles, and methods of making the same. In one embodiment, a method of marking an article can comprise: combining a thermoplastic with a light-marking additive to form a composition, forming the composition into an article having a maximum optical absorption wavelength; and illuminating, at a marking wavelength, at least a portion of the article with a device having a power of less than or equal to about 200 mW, to form a light-mark. The light-mark can have a size, as measured along a major axis, of greater than or equal to about 10 micrometers. The light-mark can also have a mark absorption wavelength that is greater than or equal to about ±100 nm of the maximum optical absorption wavelength, and can have a spectral absorption curve.

In one embodiment, a light-markable article can comprise a thermoplastic and a light-marking additive. The light-marking additive can be capable of forming a light-mark having a size, as measured along a major axis, of greater than or equal to about 10 micrometers, when illuminated, at a marking wavelength, using a device having a power of less than or equal to about 200 mW for a period of time of less than or equal to about 60 seconds. The light-mark can have a spectral absorption curve.

The above described and other features are exemplified by the following figures and detailed description.

BRIEF DESCRIPTION OF THE DRAWINGS

Refer now to the figures, which are exemplary embodiments, and wherein the like elements are numbered alike.

DETAILED DESCRIPTION

Figure 1:
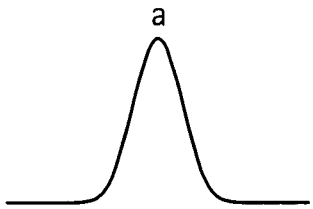
FIGS. 1-6 are exemplary illustrations of possible focused light-mark profiles within the substrate.
Figure 2:
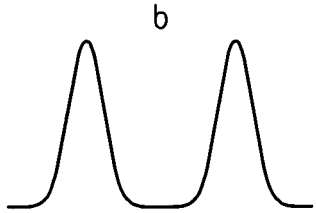
Figure 3:
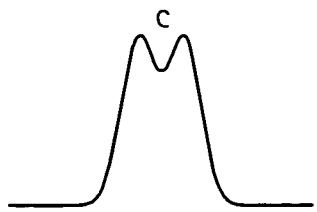
Figure 4:
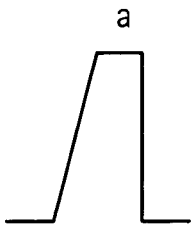
Figure 5:
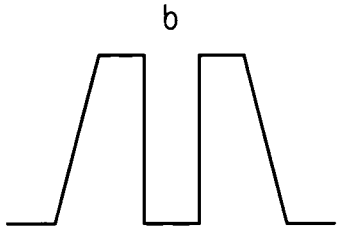
Figure 6:
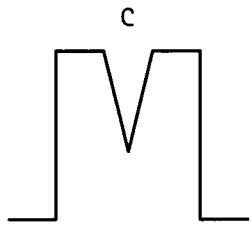

It is noted that the terms "first," "second," and the like, herein do not denote any amount, order, or importance, but rather are used to distinguish one element from another, and the terms "a" and "an" herein do not denote a limitation of quantity, but rather denote the presence of at least one of the referenced item. Additionally, all ranges disclosed herein are inclusive and combinable (e.g., the ranges of "up to 25 wt %, with 5 wt % to 20 wt % desired," are inclusive of the endpoints and all intermediate values of the ranges of "5 wt % to 25 wt %," etc.). The modifier "about" used in connection with a quantity is inclusive of the stated value and has the meaning dictated by the context (e.g., includes the degree of error associated with measurement of the particular quantity). Compounds are described using standard nomenclature. For example, any position not substituted by any indicated group is understood to have its valency filled by a bond as indicated, or a hydrogen atom. A dash ("-") that is not between two letters or symbols is used to indicate a point of attachment for a substituent. For example, —CHO is attached through carbon of the carbonyl group.

Governments, employers, agencies, and so forth desire to be able to distinguish an authentic article from a counterfeit article. Graphics and/or images may be formed in the authentic articles to facilitate authentication. A unique identifier can also be disposed in the article (optionally embedded in a graphic or image) such tat the article can be objectively authenticated (e.g., authenticated using a machine and not merely visual inspection by an individual). This authentication could be totally handled locally (e.g., for a company), remotely, or a combination thereof (e.g., an airport scanner could access a central database to determine whether a passport is authentic, whom it is issued to, and possibly even provide a picture of the party to enable visual identification by the airport personnel). Serial numbers or unique identifiers (ID) can be used to prevent access (e.g., entrance into a computer, building, facility, country, and the like), and may optionally be embedded.

Disclosed herein are injection-moldable, light-markable (e.g., laser markable), thermoplastic compositions (e.g., transparent thermoplastic compositions), articles, systems, methods for creating different types of light-marks (e.g., spots) in bulk thermoplastic compositions (e.g., in the substrate), methods of encoding data, using the encoded data, and methods of reading back encoded data to form a unique identifying sequence. For example, disclosed herein are methods of light-marking thermoplastic articles with low power (i.e., less than or equal to about 200 mW) diode lasers, the use of this method in the production of secure documents (e.g., identification (ID) cards), methods of implanting additional security layers (e.g., unique identifier(s)) in thermoplastic articles (e.g., the ID cards) using the light-marking method, detecting the unique identifiers in the articles, and the use of the detected unique ID to provide access, privileges, etc., and the like.

An ID card, for example, can comprise a core layer (e.g., reflective thermoplastic layer, such as a white thermoplastic layer), and a transparent film layer that comprises the light-marking additive. Optionally, a cap layer can be disposed on a side of the transparent film layer opposite the core layer, e.g., to protect against scratches, provide added chemical resistance, and/or light resistance. The layers can be assembled via a co-extrusion process, co-lamination processes, and the like. Ultra thin layers (less than or equal to about 100 micrometers) can be formed first by an extrusion, a melt casting, or solvent casting process, and optionally stretched to reach the desired thickness. The cap layers, and other optional layer(s), can be added (e.g., in the form of a coating) that can be cured by an energy source such as a UV lamp. Other possible layers in the ID card include: a metallic layer, a magnetic layer, a layer with angular metamerism properties, and the like, as well as combinations comprising at least one of the foregoing layers.

The thickness of the core layer can be about 0.25 millimeter (mm) to about 2 mm, or, more specifically, about 0.5 to about 1 mm. The light-markable layer (e.g., the transparent film layer) can have a thickness of about 12 micrometers (μm) to about 300 micrometers, or, more specifically, about 25 micrometers to about 200 micrometers, and, even more specifically, about 50 micrometers to about 100 micrometers.

Although the thermoplastic composition may sometimes be discussed herein as polycarbonate for simplicity of discussion, it is understood tat any transparent (e.g., a haze of less than or equal to about 3.5% (e.g., as measured using a Hazegard Plus commercially available from BYK Gardner), or, more specifically less than or equal to about 2.5%, or, even more specifically, less than or equal to about 1.5%, and can have transmission at a read wavelength, if an optical reader will be employed. If no optical reader will be employed, a total light transmission (as measured by ASTM D1003), of greater than or equal to about 80%. Thermoplastic suitable for the particular application can be employed; the thermoplastic may be optically clear, transparent, opaque, cloudy, and/or have a roughened surface finish. Additionally, the composition can comprise various additives to enhance the desired functionality of the thermoplastic. Non-limiting examples of possible functionalities include visual, aesthetic, and any other effects, as well for solvent resistance, sweat-resistance, flame-resistance, and any other performance enhancements. Some possible thermoplastics include, for example, polycarbonate, polyacrylates, cyclic polyolefins, and the like, as well as combinations comprising at least one of the foregoing thermoplastics, such as transparent polycarbonate homopolymers, copolymers, polycarbonate blends, and the like.

The plastic composition can have sufficient absorption of energy (function of wavelength and power) at the marking wavelength so as to create a light-mark that will induce changes in optical properties of the media at the read wavelength (increase or decrease of absorption or change in scattering properties). Typically, the marking wavelength is different from the read wavelength, but in certain cases, the marking wavelength can be the same as the read wavelength. The plastic composition (i.e., the polycarbonate with the light-marking additives) can be optically clear with a haze of less than or equal to about 2%, specifically less than or equal to about 1.5%, and more specifically less than or equal to about 1%, as measured using a HazeGard or HazeGard Plus from BYK Gardner on a 2.5 millimeter (mm) thick color plaque. Optically clear injection molded substrates have an electrical error count within specifications for the particular article format when molded using appropriate conditions for the format.

The plastic compositions can have a sufficient stability, e.g., (i) a stability of transmission properties at the readback wavelength retained at greater than or equal to about 60%, specifically greater than or equal to about 75%, or more specifically greater than or equal to about 85% transmission after substrate molding at the appropriate article; (ii) stability of polymer molecular weight or polymer melt viscosity to allow consistent forming of the article with minimum variation in thickness and quality of replication without adjusting process conditions; and/or (iii) parallel plate rheology, e.g., having a melt viscosity shift at 300° C., after a dwell time of 30 minutes, of less than or equal to about 15%, more specifically, less than or equal to about 10%, and more specifically less than or equal to about 5% are suitable for some applications.

The plastic can be any injection moldable thermoplastic capable of being injection molded at temperatures of greater than or equal to about 250° C., or, more specifically, greater than or equal to about 280° C., and even more specifically, greater than or equal to about 310° C. For example, the plastic can be transparent polycarbonate, or, more specifically, injection moldable, optically clear polycarbonate. The polycarbonate compositions can optionally have a weight average molecular weight (Mw) of about 15,000 atomic mass units (amu) to about 50,000 amu, or, more specifically, about 17,500 amu to about 18,500 amu.

The light-marking additive of the plastic composition can comprise any material that can disperse in the plastic without adversely affecting desired properties of the plastic (e.g., optical properties). Desirably, the light-marking additive can be processed under the same conditions as the plastic e.g., capable of being injection molded at temperatures of greater than or equal to about 250° C., or, more specifically, greater than or equal to about 280° C., and even more specifically, greater than or equal to about 310° C. for a period of time of greater than or equal to about 5 minutes, while maintaining its properties. For example, the light-marking additive can be a material with a size of less than or equal to about 50 nanometers (nm), or, more specifically, less than or equal to about 25 nm, or even more specifically, and less than or equal to about 10 nm,). Optionally, the light-marking additive can be a material that does not affect transparency at a read wavelength and subsequently alters reflection (and/or transmission, as applicable) of the energy (e.g., absorbs the energy (e.g., light), refracts light, scatters the energy, and/or the like) at the read wavelength after it has been contacted with a marking wavelength (e.g., from a light, laser, and/or the like). The alteration can be an increase or decrease in reflection in the light-marked areas, essentially coming from marking of the thermoplastic substrate and not from damage to the backing layer (e.g., reflective layer such as metallization or a reflective white core layer in ID cards). For example, the material can change optical properties (e.g., change state upon stimulus by the marking wavelength and/or upon stimulus by a secondary component in the composition which is excited by the marking wavelength). Light absorption, for example, at the marking wavelength can be greater than or equal to about 0.5 absorbance units, or, more specifically, greater than or equal to about 1.0, or even more specifically, greater than or equal to about 2.0. Absorbance can be measured on color plaques using a spectrophotometer. This absorption enables a permanent change of state resulting in an alteration of reflectivity at the read wavelength in the light-marked areas (i.e., the change of state is not readily reversible such as between an absorbing and non-absorbing state); e.g., an absorbing state can not be changed back to a non-absorbing state other than by a process involving an irreversible degradation of the absorbing state. Even with fading and exposure to aggressive exposure conditions (e.g., prolonged sunlight exposure), the light-marks remain permanent, i.e., provide sufficient alteration at the read wavelength and do not revert to their original state. Reflectivity and transmission are altered by a light-mark that absorbs, refracts, and/or scatters light differently than the bulk optical material (i.e., the non-marked area of the substrate). For example, a light-mark can create a machine-readable signal if its reflectivity is either sufficiently lower or sufficiently higher than the bulk material (e.g., the remainder of the material). A light-mark can also be used to create contrast zones, forming graphics or images that can be detected by the human eye (with or without magnification), depending on the size of the pattern formed.

Exemplary light-marking additives can include: aryl carbonium precursors (aryl methane, aryl carbinol, phthalein, sulfones phthalein, fluorans derivatives, and so forth), stable chromophores with photolabile groups (more specifically rylenes, anthraquinones and anthrapyridones chromophores), and leuco-dyes (e.g., photosensitive and/or heat sensitive leuco-dyes, such as blocked leuco-arylmethane dyes, carbamate blocked leuco-phenoxazine, leuco-phenothiazine, and so forth), and the like, as well as combinations comprising at least one of the foregoing light-marking additives. Structures of some of the aryl carbonium precursors are illustrated below. Examples of phthalein derivatives include Crystal Violet Lactone, phenolphthalein, and the like.

Formula I

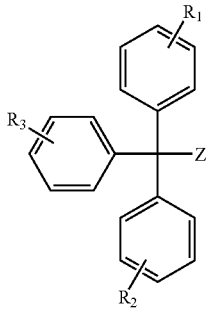

For an aryl methane dye, Z can be H; an aryl carbinol dye, Z can be OH; and for a substituted aryl methane dye, Z can be O-acyl, O-aryl, O-alkyl, O-silyl, N-alkyl, N-aryl, amide, carbamate, xantate, halogen (e.g., fluoro, chloro, bromo, iodo, and the like), cyano group, nitrile group, S-alkyl, S-aryl, Si-alkyl, Si-aryl, or Si-alkoxy. Optionally, Z can be a photolabile carbonyl group (—CO-M wherein M is an aryl group), a carbonate group (—O—CO—O-M), chalcogen (oxygen, sulfur, selenium, tellurium, and the like), or a sulfonate group (—O—$SO_2$-M wherein M can be an aryl substituent). Examples of aryl methanes include leuco Crystal Violet, leuco Malachite Green, and the like. $R_1$-$R_3$ can be, individually, organic substituents that may be linear or cyclic, aromatic or aliphatic. These substituents can include amino, alkyl (e.g., alkyl ether, cycloalkyl, and the like), sulfonyl, ether (e.g., thioether, cyclic ether, aryl ether, and the like), halogens, aryl, acyl, carbonate, carbonyl, hydroxy groups, ester (e.g., thioester, and the like), heterocyclic, and the like, as well as combinations comprising at least one of the foregoing substituents. Adjacent substituents may also be part of a fused ring. $R_1$-$R_3$ can be selected to create the desired color in the oxidized form and to limit the color contribution of the leuco form (e.g., an absorption cut-off of less than or equal to about 420 nm, or, more specifically, of less than or equal to about 400 nm, and even more specifically, of less than or equal to about 380 nm, at the desired loading in the composition.

Formula II

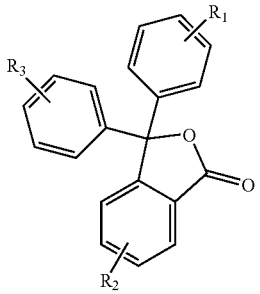

Formula III

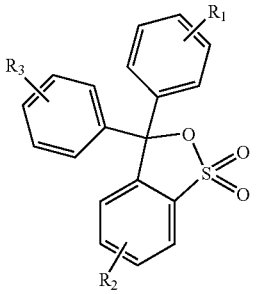

Formula IV

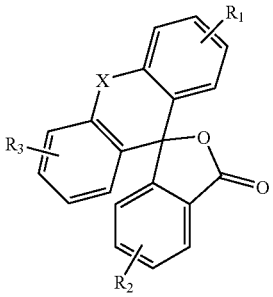

The aryl carbonium dye precursors are phthalein derivatives (Formula II), sulfone phthalein derivatives (Formula III), and fluorans (Formula IV), where X can be O or S, with phthalein derivatives having higher heat stability than sulfone phthalein. $R_1$-$R_3$ can be the same as set forth above with respect to Formula I. Unless specifically set forth to the contrary, $R_1$-$R_8$ discussed herein are as set forth with respect to $R_1$-$R_3$ in Figure I.

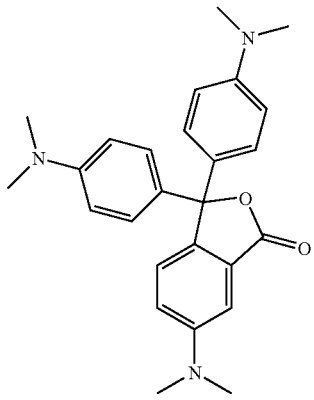

Formula V: Crystal Violet lactone (CVL)

-continued

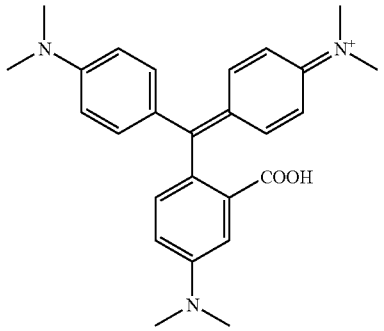

Formula VI: Aryl carbonium dye

The light-marking additives that are stable chromophores with photolabile groups (e.g., carbamate, urethane, sulfonate, and the like, as well as combinations comprising at least one of the foregoing groups) are molecules bearing urethane, sulfonate, and/or carbonate labile groups attached to a substituent that contributes to the electronic conjugation of the chromophore. Not to be limited by theory, it is believed that the labile group can act as an electron-withdrawing group and thus shift the maximum absorption peak of the dye to lower wavelengths. Upon laser exposure, the labile group can come off the molecule and the maximum absorption will be shifted towards higher wavelengths. Dyes in the anthraquinone, perylene, terrylene, and quaterrylene families are especially interesting in this family because they can be used as colorants in engineering plastics, and can generally disperse easily in resin matrices such as polycarbonate without inducing significant scattering (i.e., haze in polycarbonate composition at 3 mm can remain below 3% or lower depending on the dye loading and mold surface properties).

These chromophores can also have bare amine functionalities that can be modified to form a urethane bond (e.g., by reacting a chloroformate $R_2OCOCl$ with the dye (—NH—$R_1$) in alkaline conditions), to form thermally labile groups that affect the conjugation of the molecule (transformation of —NH—$R_1$ into —$NR_1$—CO—O—$R_2$). The $R_2$ substituent can be engineered to survive extrusion and molding but come off during the light-marking step. Generally, tertiary alkyl substituent exhibit the lowest heat stability (e.g., case of a t-Butyl group) compared to primary alkyl such as n-butyl group. If $R_2$ is a benzylic derivative (and especially a nitro substituted benzyl group), the dye can be photolabile in the UV region and a laser could then be used directly to remove the labile group and thus shift the maximum absorption of the dye.

Non-limiting examples of dyes of this family include anthraquinone compounds as illustrated in Formulas VII to X, while Formulas XI to XIII illustrate rylene derivatives (perylenes (n=0), terrylenes (n=1 or more) and quaterrylenes (n=2)):

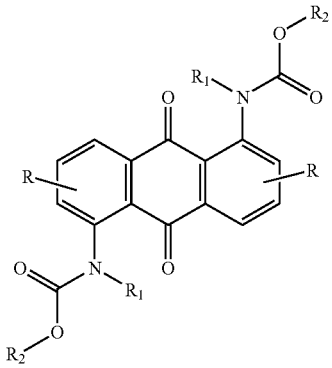

Formula VII: 1,5-anthraquinones

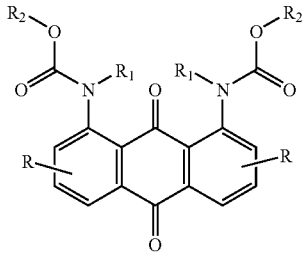

Formula VIII: 1,8-anthraquinones

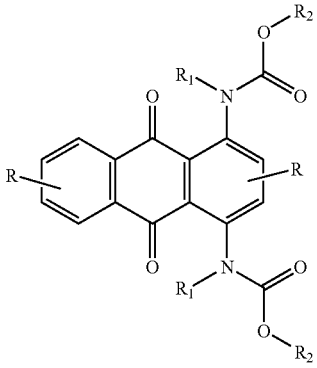

Formula IX: 1,4-anthraquinones

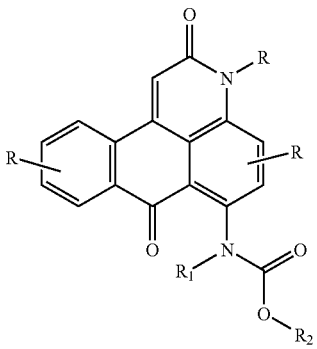

Formula X: anthrapyridone sub-class

-continued

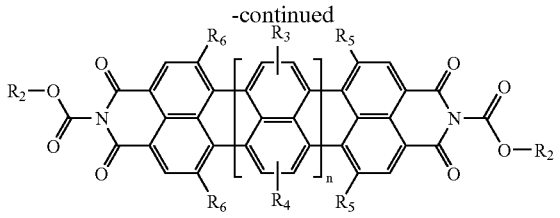

Formula XI: rylenebis(dicarboximide) derivatives

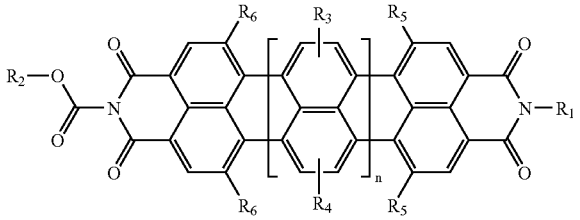

Formula XII: rylenebis(dicarboximide) derivatives

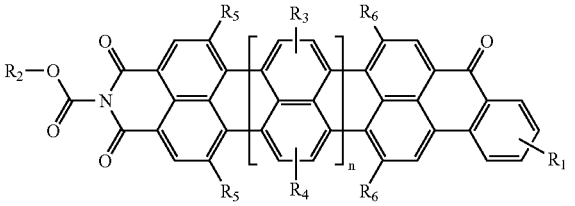

Formula XIII: ryleneimides where $R_3$-$R_6$ are, individually, a halogen atom, an hydroxy group, an amino group, an alkyl group, an alkyl ether group, a cycloalkyl group, a cyclic ether group, an aryl group, an aryl ether group, an heterocyclic group, a carbonyl group, an ester group, a sulfonyl group, or a carbonate group. $R_1$, individually, represent a hydrogen, an alkyl group, an alkyl ether group, a cycloalkyl group, a cyclic ether group, an aryl group, an aryl ether group, an heterocyclic group, and/or the like. $R_2$ is, individually, an alkyl group, an alkyl ether group, a cycloalkyl group, a cyclic ether group, an aryl group, an aryl ether group, an heterocyclic group, an nitro-substituted aryl group, and/or the like. R represents single or multiple substituents including, but not limited to, hydrogen, hydroxy, and linear or cyclic groups including: alkyl, alcohol, alkoxy, aryl, sulfonyl, ketone, urethane, ester, ether, and thioether functionalities. Examples of rylene compounds that could be modified to form the molecules Formula XI to XIII and their synthesis are reported in the article from K. Müllen and co-workers in the Journal of Materials Chemistry (1998), volume 8(11), pp 2357-2369.

Photosensitive blocked leuco light-marking additives are molecules that are formed by attaching a labile group to a leuco dye such that the dye remains blocked in a leuco form during the formation of the markable composition (i.e., handling, extrusion, and molding) and can be deblocked when exposed to the marking laser. Upon deblocking, the leuco dye easily converts to its oxidized form (for instance by an oxidation process involving the presence of oxygen) that absorbs light at a higher wavelength than the leuco form. This absorption is generally located in the visible part of the electromagnetic spectrum thus leading to the formation of a visible (colored) mark. Examples of leuco dyes include azine dyes such as phenazines, phenoxazines, phenothiazines, and so forth. Formula XVI represents a generic structure for a blocked azine dye (X═N for phenazine; X═O for phenoxazines, and X═S for phenothiazines).

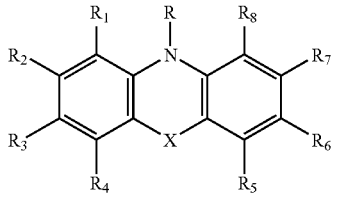

Formula XIV: Generic structure of blocked azine leuco dye

R can be a substituent that forms a urethane or an amide bond with the leuco dye with sufficient heat stability to sustain the extrusion and molding process. Examples of substituents include acyl groups, ester groups (—CO—X where X represents an alkyl or an aryl substituent), and the like. For example, R can be a benzoyl group. Fomula XV represents benzoyl leuco methylene blue (BLMB); a blocked leuco dye that is photosensitive, especially in the presence of a photoacid generator (PAG).

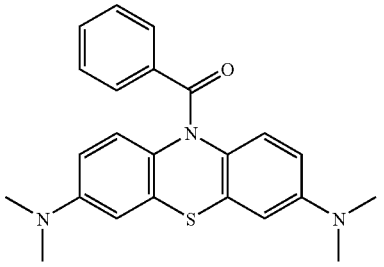

Formula XV: Benzoyl leuco methylene blue (BLMB)

In addition to the plastic and the light-marking additive, the substrate can comprise a photoacid generator (also know as latent acid) that locally changes the acidity of its surroundings after irradiation or application of heat. The photoacid generator(s) can be non-ionic, particularly when used in polycarbonate applications. Suitable photoacid generators include, for instance, a sulfonate derivative $R_9SO_2OR_{10}$, and the like, as well as combinations comprising the sulfonate derivative $R_9SO_2OR_{10}$. $R_9$ can be substituent designed such that $R_9SO_3H$ is a strong Bronsted acid ($R_9$ typically contains an electron withdrawing group such as an alkyl, an aryl, a perfluoroalkyl group, or the like). $R_{10}$ can be a group designed to absorb light and create the sensitivity of the photoacid generator. Therefore, $R_{10}$ can be an aromatic group, such as an aryl group, or the like. The photoacid generator can be multifunctional. For example, $R_{10}$ can be a trisubstituted phenyl moiety with 3 sulfonate groups located in positions 1, 3, and 5 of the phenyl ring. Examples of photoacid generators include N-hydroxyphthalimide triflate, N-hydroxynaphthalimide triflate, N-hydroxy-5-norbornene-2,3-dicarboximide perfluoro-1-butanesulfonate (e.g., commercially available from Sigma-Aldrich); 1,1'-bi-2-naphthol bis(trifluoromethanesulfonate) (e.g., commercially available from Strem Chemicals, MA). The latent acid can be covalently bonded to a polymer or otherwise immobilized, such as encapsulated in a shell and released from the shell upon exposure to heat, pressure, and/or light.

The amounts of the various components of the plastic composition are dependent upon sufficient light-marking additive to enable marking of the substrate with minimal damage to the backing layer (e.g., such that no damage to the backing/core layer is visible from the non-read or label side of the disc (i.e., the side opposite the mark), and no damage is visible to the metallization using optical microscopy from the same side as the mark), and optionally, sufficient photoacid generator to react with the light-marking additive. The amount of light-marking additive depends on the extinction coefficient of the additive at the marking wavelength and also on the extinction coefficient of the marked species at the read wavelength. There can be a sufficient amount of light-marking additive such that, when marked, the mark will be detectable by the optical reader and/or by the human eye (e.g., there will be a sufficient change in reflectivity). For some light-marking additives, the amount present can be greater than or equal to about 0.001 wt %, based upon the total weight of the substrate. The amount of light-marking additive can be less than or equal to about 5 wt %, or, more specifically less than or equal to about 3 wt %, or, even more specifically less than or equal to about 1 wt %, and even more specifically, less than or equal to about 0.5 wt %. Typically an equimolar ratio of light-marking additive to photoacid generator can be used, e.g., 0.9 to 1.1 mole percent (mole %) of photoacid function for every mole of the light-marking additive.

In addition to the plastic, the light-marking additive, and the photoacid generator, the substrate can comprise additional additive(s) such as filler(s), reinforcing agent(s), heat stabilizer(s), colorant(s), antioxidant(s), light stabilizer(s), plasticizer(s), antistatic agent(s), mold releasing agent(s), additional resin(s), blowing agent(s), flame retardants(s), or the like, as well as combinations comprising at least one of the foregoing additional additives, that can be employed in the particular article (e.g., that will not adversely affect the desired properties of the article).

The size and geometry of the plastic with the light-marking additive is dependent upon the application. For example, where the plastic can be a core layer that has a thickness of less than or equal to about 0.3 mm, wherein the article comprising a core layer and a light-markable layer, can have a thickness of greater than or equal to about 0.3 mm, or, more specifically, greater than or equal to about 0.6 mm. The substrate could also be for use as a smart ID card, passport, or the like, e.g., containing a data layer (e.g., pits and lands, or high and low reflectivity regions) with a structure similar to optical discs.

The amounts of the various components can vary. For example, the composition can comprise about 0.001 wt % to about 5 wt % light-marking additive, or, more specifically, about 0.01 wt % to about 3 wt % light-marking additive. The composition can also comprise greater than or equal to about 80 wt % thermplastic, or, more specifically, greater than or equal to about 90 wt % thermplastic, or, even more specifically equal to about 95 wt % thermplastic, depending upon the application and the presence of fillers, other additives, and the like. When employed, the photoacid generator can be present in greater than or equal to about a stoichiometric amount.

This technology is especially interesting in the case of transparent thermoplastics, where no current technology exists to create colored light-marks with low power diode lasers (e.g., a power of less than or equal to 200 milliwatts (mW)); e.g., visible light diode laser, near infrared (NIR) diode laser, and so forth. Depending upon the sensitivity of the light-marking additive employed and the desired marking time, the laser can have a power of less than or equal to about 200 mW (e.g., while forming a mark having a size of greater than or equal to about 10 micrometers (or, more specifically, greater than or equal to about 50 micrometers or, even more specifically, greater than or equal to about 100 micrometers) in a period of time of less than or equal to about 60 seconds, or more specifically, less than or equal to about 100 mW, and even more specifically, less than or equal to about 50 mW, and even more specifically, about 2 mW to about 15 mW. The period of time can be less than or equal to about 30 seconds, or, more specifically, less than or equal to about 10 seconds, or, even more specifically, less than or equal to about 5 seconds, and, yet more specifically, less than or equal to about 1 second, and, even more specifically, about 50 milliseconds to about 1 second.

Optionally, multiple lasers (e.g., two or more) using different marking wavelengths could be employed with multiple light-marking additives (e.g., two or more) having different colors and different light absorption characteristics to form multi-color laser marks and/or to enable single colors that could not be obtained by using only one light-marking additive. The laser diodes can operate at a wavelength of about 157 nm to about 410 nm.

ID cards for instance can contain a special reflective region (e.g., metallized layer) or the base reflectivity of the core layer (e.g., highly reflective white layer with reflectivity greater than or equal to about 80%). In order to enable readability of the data layer (which can comprise a separate layer and/or comprise pits and lands in the substrate surface), the electrical reflectivity of the non-marked regions can be greater than or equal to 30%, and more specifically, greater than or equal to 45%, and, in some applications, greater than or equal to 65%. Reflectivity typically refers to optical reflectivity and can be measured, for example, using a fiber optic spectrophotometer (e.g., Ocean Optics S2000) by calculating the ratio of reflected light to the amount of incident light at one wavelength or across a range of wavelengths.

The light-mark(s), one or more of which may optionally be encrypted, can be formed in one or more substrate(s) forming the article, and can be detected in a scanner (e.g., a laser scanner), for example, due to a reflectivity difference between the light-mark and the unmarked area of the article. The reflectivity difference, for example, can be greater than or equal to 15%, or, more specifically, greater than or equal to 30%, and even more specifically, greater than or equal to 45%. Additionally, the unmarked area can have a maximum optical absorption wavelength, while the light-mark can have a mark absorption wavelength that is greater than or equal to about ±100 nm of the maximum optical absorption wavelength, or, more specifically, a mark absorption wavelength that is greater than or equal to about ±200 nm of the maximum optical absorption wavelength, or, even more specifically, a mark absorption wavelength that is greater than or equal to about ±300 nm of the maximum optical absorption wavelength. In other words, if the maximum optical absorption wavelength peak, prior to marking, is about 350 nm, the light-mark will have a mark absorption wavelength of greater than or equal to about 450 nm (or less than or equal to about 250 nm).

The pattern of the light-mark(s), (e.g., length and/or width of a light-mark, and/or the length, width, and/or spacing between light-marks) can be tailored to create unique reflectivity patterns (e.g., sinusoidal waves, step changes, and the like, as well as combinations comprising at least one of these patterns). For example, the laser spatial profile inside the disc substrate can be a signature of the light-mark. Depending on the laser beam entering the focusing lens, the focused light-mark in the disc substrate can be, for example, Gaussian, Airy (sinc function), flat top, and the like, as well as combinations comprising at least one of the foregoing. (See FIGS. 1-6) The light-mark can have an indistinct geometry or can form a special pattern (e.g., a logo, trademark, word, shape, and the like, as well as combinations comprising at least one of the foregoing). In addition, the light-mark can follow a specific path like a CD-R groove, or it can form its own path with a special periodicity. In the latter case, the laser (or light) power can be modulated to create a wobble path with alternating regions of high and low reflectivity and the periodicity could enable some form of tracking.

The light-mark size, that can be microscopic or macroscopic, is dependent upon the device employed to form the light-mark. For example, the light-mark can be as small as 1 micrometer in diameter (measured along the major axis (i.e., the longest axis), so that it can only be seen with magnification (e.g., with a microscope)). For example, the light-mark diameter can be 0.1 micrometer to 100 micrometers. On the substrate surface, the light-mark size can be as large as 0.5 millimeters (mm) or so. In order to light-mark content in a localized address (e.g., one or more adjacent logical block addresses), the light-mark can be small (e.g., less than or equal to about 100 micrometers) and at a depth close to the reflective layer. A series of light-marks can also form a pattern, e.g., wherein each individual light-mark has a special feature. For example, the pattern can be a company logo formed by multiple light-marks (e.g., is a logo, or the like).

Light-mark(s) can be divided, for example into two basic categories; visible by a naked eye and visible with a visualization equipment. The smallest size of marks visible by a naked eye can be down to about 5 micrometers and will depend on the optical contrast of the mark. Optical contrast here is the ratio of amount of light reflected toward the eye from the mark over the amount of light reflected from the region next to the mark. Marks visible with visualization equipment can be as small as 10 nanometers if produced and probed with a near-field, optics.

One way to create a unique serial number is to control the placement, size, and/or design of light-marks so that each article has a unique pattern of light-marks that translates into an identifier (e.g., a serial number), which can optionally be embedded into an image or a graphic. The Unique ID can be formed by molding an article comprising the desired data and optionally the inspection data (e.g., the information regarding the unique ID, such as location, etc.). The molded article comprises the data layer, reflective layer(s), and optionally other layers. The Unique ID can then be formed into the molded article by contacting the article with energy (e.g. light such as a laser light). The energy contacts the light-marking additive in the substrate, forming mark(s) or a series of marks, post-molding, at locations co-incident with the inspection data.

The light-marks can be formed with an energy source such as a laser (e.g., pumped solid state, dye and semiconductor diode lasers), and/or other light sources (e.g., UV lamps used in conjunction with photomasks, spatial light modulators, and the like), as well as combinations comprising at least one of the foregoing energy sources. Low power laser diodes offer a lower capital investment, lower maintenance and downtime, as well as other advantages. Depending upon the sensitivity of the light-marking additive employed and the desired marking time, the laser can have a power of less than or equal to about 200 milliwatts (mW), or more specifically, less than or equal to about 150 mW, and even more specifically, less than or equal to about 100 mW (e.g., about 30 mW to about 100 mW). Non-limiting examples of low power lasers are presented in Table 1. Depending upon the sensitivity of the light-marking additive employed and the desired marking time and the size of the desired mark, the laser can have a power of less than or equal to about 200 milliwatts (mW) (e.g., while marking in a time of less than or equal to about 1 second (see)), or more specifically, less than or equal to about 100 mW (e.g., while marking in a time of less than or equal to about 10 sec), and even more specifically, less than or equal to about 50 mW (e.g., while marking in a time of less than or equal to about 30 sec), and even more specifically, about 2 mW to about 15 mW (e.g., while marking in a time of less than or equal to about 60 sec).

TABLE 1

| Source | Spectral range of emission (nm) |
|---|---|
| Continuous wave | |
| Diode lasers | different diode lasers cover about 400 to 1,500 nm |
| Pulsed | |
| Nd: YAG laser | fundamental - 1064 nm, frequency doubled - 532, tripled - 355 nm |
| Ti: Sapphire laser | fundamental 720-1,000 nm, frequency doubled 360-500 nm |

Possible laser diodes for reading and tracking in optical drives and testers include, for example, blue lasers (405±30 nm), red lasers (650±30 nm), and near-IR laser (780±30 nm). In one embodiment, the light-mark can be created such that it is in the substrate and does not physically damage other portions (e.g., the metallization or the surface) of the article, yet provides sufficient reflectivity difference (e.g., higher or lower reflectivity) from the surrounding unmarked medium to create a distinct (i.e., a measurable and/or a visible) pattern, i.e., an identifier. The difference in reflectivity between a light-mark and an unmarked area of the article (or composition) is sufficient such that the read device (which may be the human eye) can distinguish light-marks from unmarked areas. A large light-mark can be formed by marking multiple small light-marks such that detectable uncorrectable errors are created. If the small light-marks were singly disposed or disposed with a low density, they would be interpreted as correctable in the optical drive, but because the multiple light-marks are marked in close proximity to one another, they cause an uncorrectable error.

In order to light-mark the article (e.g., to place a mark in the substrate), the substrate is contacted with sufficient energy (e.g., laser energy) to cause the light-marking additive to form a mark in the substrate (e.g., absorbs energy and creates a spot). Desirably, the energy is insufficient to damage (e.g., to burn, or the like) the substrate (e.g., polycarbonate), or backing layer, e.g., does not produce damage visible to the human eye. For example, a laser can be pulsed (running at 10 to 100 kilohertz (kHz)), continuous wave (CW), or quasi-CW. Quasi-CW is pulse laser running at very fast pulse repetition rate (typically greater than or equal to 100 megahertz (MHz)), so it is operated like a CW laser to typical motion system. The laser wavelength can be ultraviolet (UV) (e.g., UV laser, diode pumped solid-state laser, or the like), visible (e.g., solid state laser, diode, or the like), or infrared (e.g., diode, solid state laser, or the like), or the like. Desirably, the laser wavelength sufficiently matches an absorption wavelength of the light-marking additive to cause a chemical and/or physical property change in the additive.

Various laser focus schemes can be used to focus the laser mark at various depths inside the substrate, wherein reading laser focuses on the reflective or metallized layer. For example, the marking laser can be focused so that the light-marked dye pattern is like a funnel inside the substrate. If the light-mark size is large (e.g., about 100 micrometers), a collimated laser beam can be used so that the light-marked additive has the same light-mark size throughout the article. Alternatively, a non-linear absorbing dye (e.g., absorbance characteristic of the dye is not a linear function of the laser power) could be used together with a laser focused at the content layer to write a sub-micrometer feature inside the substrate.

Figure 7:
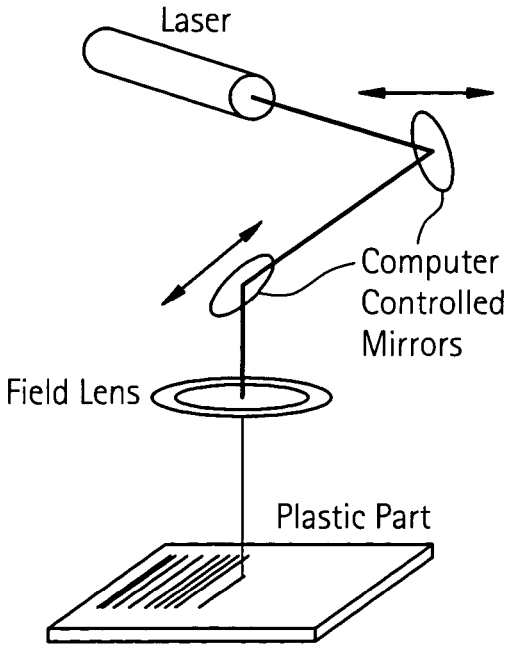
FIG. 7 is an illustration of one embodiment of a laser marking system using a galvo mirror.

An exemplary light marking system, as illustrated in FIG. 7, uses a galvo mirror to dispose the light-mark on the article. The advantage of this system is its speed. Since the leg can be very long, any angular movement of the mirror causes big movement on the article. But this system, however cannot write less than 10 micrometer features on the article.

Figure 8:
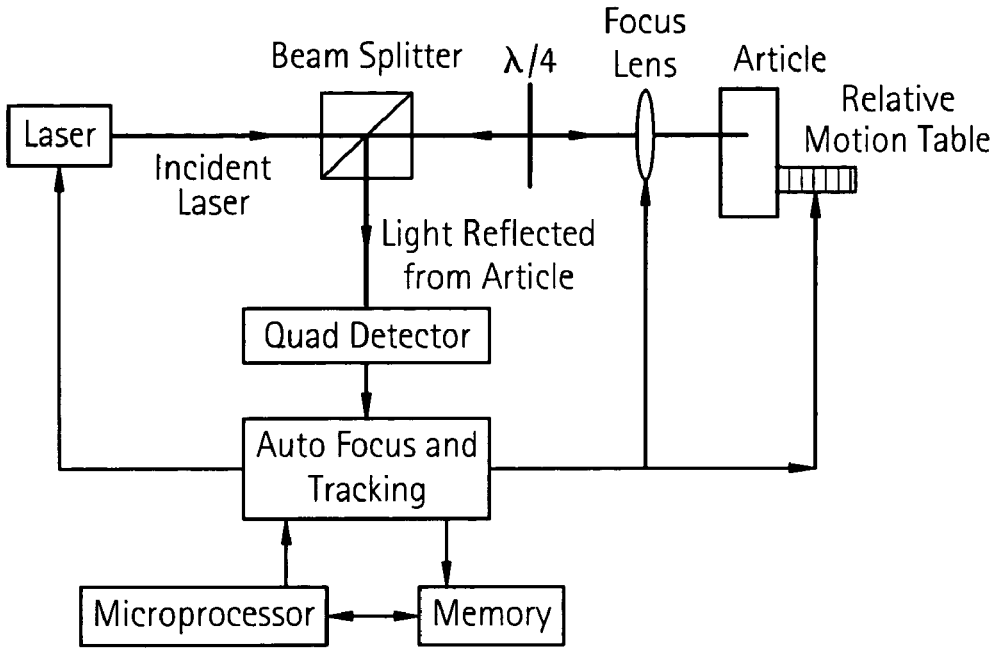
FIG. 8 is a schematic of one embodiment of a light-marking system using a modified drive.

Another exemplary light-marking system is illustrated in FIG. 8. This system moves and rotates the article. With this system, for large features, the x-y linear stage is moved. For example, Aerotech Inc. or Newport Corp. air bearing linear stage with optical encoder can attain a 0.1 micrometer accuracy. For small features, an autofocusing and tracking system can be employed. The article content can be mapped to the x-y dimension using linear stage to do the writing.

The identifier can then be recognized by the human eye (observation of a images, text, and/or graphics), during article scanning (e.g., in standard scanner) in an optical reader, and/or deciphered to provide a code (e.g., translated into a number string, unique serial number, or the like), e.g., that can be compared to a set of codes to determine the authenticity of the article. In addition, the structure of the identifier can be traced to a specific algorithm generating authentic codes, similar to some serial number generators. For example, in one embodiment, the light-mark(s) can be detected as errors by an optical disc drive and the locations of the errors can be coded into a serial number. Errors related to reading data from an optical data storage disc typically originate from three sources, focusing errors, tracking/synchronization errors, and reading errors. The light-mark(s) can be used to cause the drive to detect errors at the locations of the light-mark(s). In another embodiment, the pattern created by the succession of marks can correspond to data or a combination of data and errors (such as those marked in the polycarbonate on top of the groove, or the pattern can form a wobbling groove). If the identifier is in the form of readable data, then it can be structured so that it is in a non-standard format to avoid duplication by known techniques. It is conceivable that the special periodicity of the wobbling path can be used as an identifier to confirm the origin of the Unique ID.

EXAMPLE 1

A Polycarbonate Film with a Laser Markable Dye

A 0.1 mm thick film of polycarbonate was produced by dissolving a melt polycarbonate sample in chloroform (about 10 wt %) and adding about 1-5 wt % of crystal violet lactone (wt % in total solution to form a polycarbonate composition. The film was solvent-casted onto a glass substrate. After solvent evaporation, the film was light-marked using a 355 nm laser positioned vertically, normal to the surface of the film, at a distance of 10 cm. The laser was a compact Nd:YAG laser (commercially available from Nanolase, France) operating at 5 kilohertz (kHz) with an average laser power of 15 milliwatts (mW). The film was positioned on an XY stage. The stage was activated to move at a rate of 1 millimeter per second (mm/s) in a predetermined pattern to form the light-mark. The resultant film had a marking that was about 1 to about 2 mm in diameter that was detectable with a portable fiber-optic spectroscopic system. The system included a white light source (halogen lamp, Ocean Optics, Inc., Dunedin, Fla.), and a portable spectrometer (Ocean Optics, Model ST2000). The spectrometer was equipped with a 200-μm slit, 600-grooves/mm grating blazed at 400 nm and covering the spectral range from 250 to 800 nm with efficiency greater than 30%, and a linear CCD-array detector. Light from the source was focused into one of the arms of a "six-around-one" bifurcated fiber-optic reflection probe (Ocean Optics, Inc., Model R400-7-UV/VIS). Light reflected from the film was collected from a sample when the common end of the fiber-optic probe was positioned near the sample at a 10-20 degree angle normal to the surface. The second arm of the probe was coupled to the spectrofluorometer.

EXAMPLE 2

Injection-Molded Disc Comprising a Dye-doped Polycarbonate

Figure 9:
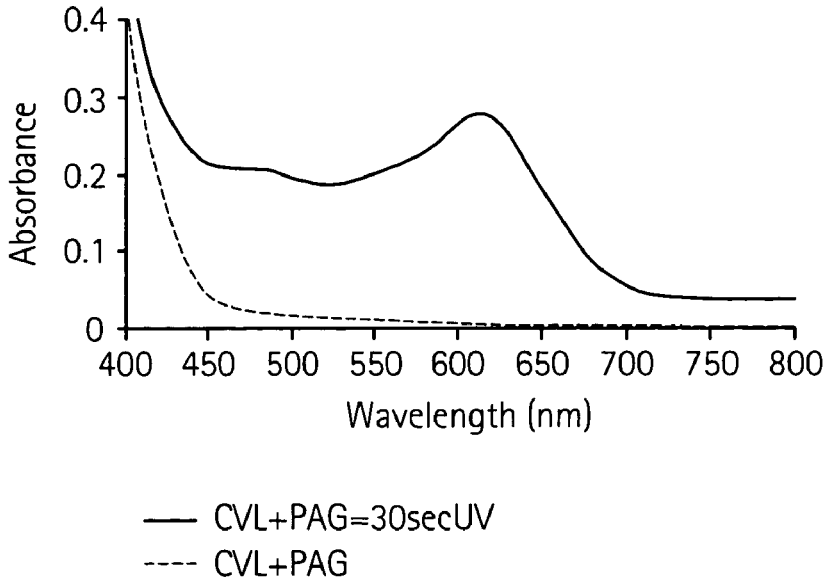
FIG. 9 is a graphical comparison of optical discs comprising crystal violet lactone and photoacid generator doped polycarbonate, with and without UV exposure.

Polycarbonate powder (500 grams) was blended with 0.672 wt % crystal violet lactone (CVL) and 0.34 wt % photoacid generator (PAG) 1,2,3-trihydroxybenzene trisphenylsuifonylester, based upon the total weight of polycarbonate, in a Henschel mixer. The blends were molded into discs 57 mm in diameter and 1,2 mm in thickness, in a Mini-jector injection molder using an injection temperature of 280° C. Comparative samples containing 3 wt % crystal violet lactone without the photoacid generator and samples containing neither crystal violet lactone nor the photoacid generator were also prepared. The samples were exposed to UV light either with a 355 nm UV laser or to a flash UV lamp (Xenon Corp.) for a period of 30 seconds. After exposure to UV light, to samples were measured using an Ocean Optics UV-Vis spectrophotometer. Spectra of the samples before and after exposure to 30 sec of UV light exposure using the Xenon flash lamp is shown in FIG. 9. Table 2 summarizes the absorbances of the samples at several wavelengths. The data indicates that the dye-doped polycarbonate discs were sensitive to exposure to UV light, as is indicated by the increased absorbances at 532 and 650 nm. Furthermore, the data indicate that the sample containing both crystal violet lactone and photoacid generator showed a greater increase in absorbance at 650 nm after UV light exposure.

TABLE 2

| Sample Disc | Absorption at 532 nm | | Absorption at 650 nm | |
|---|---|---|---|---|
| Composition | Before UV | After UV | Before UV | After UV |
| CVL only | 0.025 | 0.075 | 0 | 0.050 |
| CVL and PAG | 0.025 | 0.200 | 0 | 0.200 |

EXAMPLE 3

Light-marking of Injection-molded Discs Comprising Dye-doped Polycarbonate

Polycarbonate powder (500 grams) was blended with dyes of concentrations of 0.01 wt % to 0.3 wt %, based upon the total weight of polycarbonate, in a Henschel mixer. As in the example above, the blends were molded into discs 57 mm in diameter and 1.2 mm in thickness, in a Mini-jector injection molder using an injection temperature of 280° C. The discs were exposed to various light sources including a pulsed 355 nm Nd:YAG laser operating at 9 kilohertz (kHz) and pulse width of 400 picoseconds (ps) with an average laser power of 15 milliwatts (mW), a 532 nm Nd:YAG laser operating at 5 kilohertz (kHz) and pulse width of 400 picoseconds (ps) with an average laser power of 15 mW, a 650 nm laser diode with a continuous laser power of 60 mW, and a 780 nm laser diode with a continuous laser power of 80 mW. The samples were positioned perpendicular to the light sources at a distance of about 10 cm. The light-marking compound (e.g., dye) compositions included anthraquinones, di- and tri-arylmethines, oxazines, thiazines, anthroquinones, aza- and azo-dyes, quinones, indigo and other dyes. UV-visible absorbance spectra of the parts before and after light exposure were measured.

Table 3 summarizes the effect of the laser exposure for each dye used in the PC composition. Depending on the dye, the exposure yielded a light-mark (either a spot of higher absorbance ("darkened") or of lower absorbance ("lightened") after exposure to light), or did not form a mark under these particular conditions ("no effect"). For some of the samples ("degraded") the dyes degraded during the high-temperature molding process. It is noted that although many of the photochromic dyes set forth in Table 3 are known to be reversibly switchable between absorbing and non-absorbing states when placed in an appropriate matrix such as a coating, when these dyes were placed in the disc substrates (e.g., polycarbonate substrate), they did not exhibit a reversible behavior but have shown a surprisingly stable ("permanent") change of state.

It can be readily appreciated that an unexpected few number of polycarbonate/dye compositions can survive the injection molding process and form a detectable mark upon exposure to light from low power lasers. It can also be appreciated that some of the dyes listed below that were not light-markable using the conditions of the current experiment (including laser wavelength and power) may become light-markable if alternative experimental conditions were used (for example, if high laser power or marking time were used).

TABLE 3

| Light-marking additive (e.g., Dye) | Effect |
|---|---|
| Solvent Blue 35 | No Effect |
| Solvent Blue 59 | No Effect |
| Solvent Green 3 | No Effect |
| Nile Blue A | Degraded |
| Morin Hydrate | Degraded |
| Coomassie Brilliant Blue | Degraded |
| Indigo Blue | No Effect |
| Rhodamine 6G | No Effect |
| Fluorescein | Degraded |
| Chromotrope 2B | No Effect |
| 1,3-Bis(4-(Dimethylamino)-2-Hydroxyphenyl)-2,4-Dihydroxycyclobutenediylium(OH)2 | No Effect |
| Lumogen F Violet 570 | No Effect |
| Rhodamine 800 | Degraded |
| Crystal Violet Lactone | Darkened |
| Trypan Blue (Direct Blue 14) | No Effect |
| Methyl Green | Lightened |
| Organica Feincheme Wolfen ("Dye 1093") | Lightened |
| tetrazolium blue chloride | Darkened |
| James Robinson Plum 1 Photochromic | Darkened |
| James Robinson Palatinate Purple Photochromic | Darkened |
| Benzoyl leuco methylene blue | Darkened |
| (4-{cyano[4-(dibutylamino)phenyl]methylene}cyclohexa-2,5-dien-1-yl)malononitrile | Lightened |
| IR-786 iodide | Lightened |
| IR-775 iodide | Lightened |

EXAMPLE 4

Injection-molded CD Comprising a Light-Markable Dye-doped Polycarbonate Substrate A mixture of 12 kg of powdered polycarbonate resin (Lexan OQ1030L) was blended in a high shear mixer (Henchel Mixer, model RL086202) with 0.20 wt % crystal violet lactone and 0.30 wt % of a photoacid generator, 1,2,3-trihydroxybenzene tris-phenylsulfonylester. The blend was extruded at approximately 265° C. in a W&P twin-screw 28 mm extruder. The extruded resin system was chopped to form pellets that contained the light-markable dye/photoacid generator system. The pellets were molded into discs at approximately 335° C. in a Sumitomo SD30 injection molder with a Seikoh Giken J Type CD Mold, metallized with aluminum and coated with lacquer in a Steag Unijet to form playable CD-ROM discs.

The CD-ROM discs were light-marked with a 355 nm laser (JDS Uniphase model NV-10210-100) to form elliptical spots with dimensions of approximately 357×541 micrometers to approximately 579×825 micrometers. One CD-ROM disc was light-marked with two spots with approximate dimensions of 548×747 micrometers, at approximate locations corresponding to 8 and 18 minutes on the CD-ROM. This disc was marked and tested sequentially after 0, 1, and 2 spots were light-marked on the disc.

EXAMPLE 9

Light-marked Metalized CDs and Unmetalized Substrates

Compact Discs were prepared using a red polycarbonate (Formulation B as described in the example above). The samples were light-marked with a frequency-doubled Nd:YAG laser with a pulse-rate of 2.5 kHz to create substantially circular laser marks ranging in diameter from about 150 to 300 micrometers. The light-marking time was varied from 0.05 seconds (sec) to 1.0 seconds. Additionally, unmetalized red polycarbonate CD substrates were molded and light-marked using the same laser under similar conditions. With both the metalized red CDs and unmetalized red substrates, the spots were clearly visible in the polycarbonate substrate. When the metalized CDs were examined from the label-side of the disc (the side that had been metalized and lacquered) the spots were not visible. This suggests that the actual laser mark was in the polycarbonate substrate of the CD and not in the metalized layer. Furthermore, with both the CDs and unmetalized substrates, the spot size created at a particular light-marking time was substantially the same, indicating that the presence of the metallization layer in the CDs had little impact on the rate of formation of the light-marks in the CDs. Table 4 summarizes the light-marking time and spot size data for the red CDs and substrates.

TABLE 4

| Sample | Light-marking Time (sec) | Spot Size (micrometers) |
|---|---|---|
| Red Unmetalized Substrate | 0.05 | 145 |
| Red Unmetalized Substrate | 0.2 | 185 |
| Red Unmetalized Substrate | 1.0 | 250 |
| Red Metalized CD | 0.05 | 148 |
| Red Metalized CD | 0.2 | 206 |
| Red Metalized CD | 1.0 | 280 |

Optionally, a marking resolution (e.g., the resolution of the light-mark) can be about 100 dots per inch (dpi; i.e., dot size of about 254 micrometers), or, more specifically greater than or equal to about 200 dpi (i.e., a dot size of greater than or equal to about 127 micrometers), and even more specifically greater than or equal to about 300 dpi (i.e., a dot size greater than or equal to about 85 micrometers).

CDs were prepared using a colorless polycarbonate (Formulation A as described in Example 8 above). The samples were light-marked with the pulsed laser described in the example above. However, it was found that to create laser marks in the colorless polycarbonate discs of the present example, substantially longer light-marking times were necessary. To create a similarly sized spot with the same laser power, the laser marking time was increased from 0.05 sec in the case of the metalized red CD to 0.2 sec in the case of a metalized colorless CD (4 times as long). In addition, the quality of the spots was poor; specifically, the spots were generally non-circular and there were black marks and bubbles. The laser marks were generally of the same poor quality as the marks made in the colorless discs described in Example 8. Furthermore, when the CDs were examined from the label-side of the disc (the side that had been metalized and lacquered) the spots were visible. This suggests that the laser actually created a mark in the metalized layer, in contrast to what was observed with the red metalized CDs described above.

Unmetalized colorless polycarbonate substrates were molded and light-marked using the same laser. However, at the constant laser power, the light-marking time was increased to 5 sec to create a similarly-sized spot as in the metalized colorless polycarbonate CD samples. Under these conditions, a light-mark was created in the polycarbonate substrate. These experiments suggest that when colorless polycarbonate CDs are light-marked under the conditions described here, the mark generally is formed in the metallization layer, though some marks can form in the polycarbonate substrate under high laser power or after high light-marking times. Furthermore, the results with the colorless samples indicate that the spot sizes created at a particular light-marking time are substantially larger when the metallization layer is present. This is in contrast to the results of the red samples shown above. Table 5 summarizes the light-marking time and spot size data for the colorless CDs and substrates.

TABLE 5

| Sample | Light-marking Time (sec) | Spot Size (micrometers) |
|---|---|---|
| Colorless Unmetalized Substrate | 0.2 | 78 |
| Colorless Unmetalized Substrate | 1.0 | 111 |
| Colorless Unmetalized Substrate | 5.0 | 137 |
| Colorless Metalized CD | 0.2 | 142 |
| Colorless Metalized CD | 1.0 | 243 |
| Colorless Metalized CD | 5.0 | 333 |

The disclosed process enables the production of articles with unique identifiers. For example, a mark (e.g., identifier) can be placed in the thermoplastic without damaging metallization on the article or forming a charred area (i.e., the light-mark is not a burn mark (e.g., a black spot; a flat line), but is a colored mark (e.g., has a spectral absorption of light; a spectral absorption curve). The colored mark can also be placed in the thermoplastic without damaging or changing the morphology or texture of the surface of the article. Additionally, when these identifiers are within the substrate, they are difficult, if not impossible to remove without permanent damage to the medium. When the unique identifiers are embedded in a plastic substrate rather than applied as a coating, they are more difficult to replicate. When identifiers correspond to data or errors, they create more challenges to counterfeiters, especially when they are incorporated into other patterns like pictures or graphics. challenges to counterfeiters, especially when they are incorporated into other patterns like pictures or graphics.

With the presence of an unique identifier in an article, the authenticity of the article can be confirmed. For example, the authenticity of a passport, security card (e.g., a hospital worker, airline employee, government employee, and so forth), driver's license, medical record card, purchasing and/or payment card (such as debit/credit cards), and any picture ID card, can be confirmed with a scanner. The scanner and/or the article, can comprise computer code that facilitates the authentication. Verification of the ID can be made against reference(s), algorithm(s), and/or the like, that could be locally stored or stored in a database (accessible via the internet or an intranet); e.g., by access to a computer remotely located (such as a central government database providing verification information to the airport security station(s). This procedure can also be used to identify a stolen identification; e.g., the ID is authentic but has been identified as stolen in the central data base.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of marking a thermoplastic article, comprising:

combining a thermoplastic with a light-marking additive to form a composition;

forming the composition into an article having a maximum optical absorption wavelength; and illuminating, at a marking wavelength, at least a portion of the article with a device having a power of less than or equal to about 200 mW, to form a light-mark having a size, as measured along a major axis, of greater than or equal to about 10 micrometers;

wherein light-mark has a mark absorption wavelength that is greater than or equal to about ±100 nm of the maximum optical absorption wavelength;

wherein the light-mark has a spectral absorption curve, and wherein the article has a percent haze of less than or equal to about 3.5%.

2. The method of claim 1, wherein the percent haze is less than or equal to about 2.5%.

3. The method of claim 1, wherein the light-mark is disposed in the article.

4. The method of claim 1, wherein the light-marking additive is capable of forming the light-mark in a period of time of less than or equal to about 60 seconds when illuminated at a power of less than or equal to about 200 mW.

5. The method of claim 4, wherein the period of time is less than or equal to about 30 seconds.

6. The method of claim 5, wherein the period of time is less than or equal to about 10 seconds.

7. The method of claim 1, wherein the light-marking additive is selected from the group consisting of a aryl carbonium precursor, a stable chromophore, a photosensitive leuco-dye, and combinations comprising at least one of the foregoing light-marking additives, and wherein the stable chromophore comprises a photolabile group selected from the group consisting of carbonate, carbamate, urethane, sulfonate, and combinations comprising at least one of the foregoing photolabile groups.

8. The method of claim 1, wherein the power is about 2 mW to about 100 mW.

9. The method of claim 8, wherein the power is about 2 mW to about 50 mW.

10. The method of claim 9, wherein the power is about 2 mW to about 15 mW.

11. The method of claim 1, wherein the light-marking additive comprises the aryl carbonium precursor selected from the group consisting of aryl methane, aryl carbinol, phthalein, sulfones phthalein, fluoran, and combinations comprising at least one of the foregoing aryl carbonium precursors.

12. The method of 1, wherein the light-marking additive comprises the stable chromophore selected from the group consisting of rylenes, anthraquinones, anthrapyridones chromophores, and combinations comprising at least one of the foregoing stable chromophores.

13. The method of claim 1, wherein the light-marking additive comprises the photosensitive leuco-dyes selected from the group consisting of blocked leuco-aryl methane dyes, carbamate blocked leuco-phenoxazine, leuco-phenothiazine, and combinations comprising at least one of the foregoing photosensitive leuco-dycs.

14. The method of claim 1, wherein forming the article further comprises processing at a temperature of greater than or equal to about 250° C.

15. The method of claim 14, wherein the composition is processed for a period of time of greater than or equal to about 5 minutes.

16. The method of claim 14, wherein the temperature is greater than or equal to about 280° C.

17. The method of claim 16, wherein the temperature is greater than or equal to about 310° C.

18. The method of claim 1, wherein the light-mark has a resolution of greater than or equal to about 100 dpi.

19. The method of claim 1, wherein the light-mark is an absorbing state of the light-marking additive and wherein the absorbing state can not be changed back to a non-absorbing state other than by a process involving the irreversible degradation of the absorbing state.

20. The method of claim 1, further comprising combining the thermoplastic and the light-marking additive with a non-ionic photoacid generator.

21. The method of claim 1, wherein the device operates at a wavelength of about 157 nm to about 410 nm.

22. The method of claim 1, wherein the device is a visible light diode laser.

23. The method of claim 1, wherein the composition comprises greater than or equal to two light-marking additives having different light absorption characteristics, and wherein illuminating, at a marking wavelength further comprises illuminating at greater than or equal to two marking wavelengths.

24. The method of claim 1, wherein the article comprises thermoplastic pellets.

25. A method of marking a thermoplastic article, comprising:

combining a thermoplastic with a light-marking additive to form a composition;

forming the composition into an article having a maximum optical absorption wavelength; and illuminating, at a marking wavelength, at least a portion of the article with a device having a power of less than or equal to about 200 mW, to form a light-mark having a size, as measured along a major axis, of greater than or equal to about 10 micrometers;

wherein light-mark has a mark absorption wavelength that is greater than or equal to about ±100 nm of the maximum optical absorption wavelength;

wherein the light-mark has a spectral absorption curve; and wherein the light-marking additive comprises crystal violet lactone, and wherein the composition further comprises 1,2,3-trihydroxybenzene tris-phenylsulfonylester.

26. The method of claim 25, wherein the thermoplastic is opaque.

27. A light-markable article, comprising:

a thermoplastic, a light-marking additive, and 1,2,3-trihydroxybenzene tris-phenylsulfonylester, and wherein the light-marking additive comprises crystal violet lactone;

wherein the light-marking additive is capable of forming a light-mark having a size, as measured along a major axis, of greater than or equal to about 10 micrometers, when illuminated, at a marking wavelength, using a device having a power of less than or equal to about 200 mW for a period of time of less than or equal to about 60 seconds; and wherein the light-mark has a spectral absorption curve.

28. The article of claim 27, wherein the period of time is less than or equal to about 30 seconds.

29. The article of claim 27, wherein the power is about 2 mW to about 100 mW.

30. The article of claim 27, wherein the thermoplastic and the light-marking additive are capable of being processed at a temperature of greater than or equal to about 250° C. for a period of time of greater than or equal to about 5 minutes.

31. The article of claim 27, further comprising a non-ionic photoacid generator.

32. The article of claim 27, comprising an additional light-marking additive having different light absorption characteristic than the light-marking additive.

33. The article of claim 27, wherein the article has a percent haze of less than or equal to about 3.5%.

34. The article of claim 27, wherein the article comprises thermoplastic pellets.

35. The article of claim 27, wherein the article is selected from the group consisting of ID card, passport, security card, credit card, and debit card.

36. The article of claim 27, further comprising the light-mark.

37. The article of claim 36, wherein the light-mark has a resolution of greater than or equal to about 100 dpi.

38. The article of claim 36, wherein the light-mark is an absorbing state of the light-marking additive and wherein the absorbing state can not be changed back to a non-absorbing state other than by a process involving the irreversible degradation of the absorbing state.

39. The article of claim 27, further comprising a disk substrate comprising the thermoplastic and light-markable additive, a reflective layer disposed on the substrate, and data.

40. A light-markable article, comprising:

a thermoplastic, 1,2,3-trihydroxybenzene tris-phenylsulfonylester, and crystal violet lactone;

wherein the light-marking additive is capable of forming a light-mark having a size, as measured along a major axis, of greater than or equal to about 10 micrometers, when illuminated, at a marking wavelength, using a device having a power of less than or equal to about 200 mW for a period of time of less than or equal to about 30 seconds; and wherein the light-mark has a spectral absorption curve.

* * * * *